US007857134B2

(12) United States Patent
Koch

(10) Patent No.: US 7,857,134 B2
(45) Date of Patent: Dec. 28, 2010

(54) BOTTLE COMPRISING A TEMPORAL INDICATOR

(76) Inventor: Mark Koch, 223 W. 29th St., New York, NY (US) 10001

( * ) Notice: Subject to any disclaimer, the term of this patent is extended or adjusted under 35 U.S.C. 154(b) by 162 days.

(21) Appl. No.: 11/963,568

(22) Filed: Dec. 21, 2007

(65) Prior Publication Data

US 2008/0099423 A1 May 1, 2008

Related U.S. Application Data

(63) Continuation-in-part of application No. 11/478,458, filed on Jun. 28, 2006, now Pat. No. 7,665,611.

(51) Int. Cl.
*B65D 83/04* (2006.01)
*B65D 41/04* (2006.01)
*B65D 85/00* (2006.01)

(52) U.S. Cl. ..... 206/534; 206/459.1; 215/230

(58) Field of Classification Search ..... 206/534, 206/540, 459.5, 828, 459.1; 215/230, 200, 215/329, 365, 366, 206, 216, 217, 220, 222, 215/201, 330; 116/308, 309
See application file for complete search history.

(56) References Cited

U.S. PATENT DOCUMENTS 2,450,949 A * 10/1948 Salvadore et al. ..... 116/308
2,587,147 A * 2/1952 Guion ..... 116/308
2,706,464 A 4/1955 North
4,405,045 A 9/1983 Villa-Real
4,749,093 A * 6/1988 Trick ..... 215/220
4,802,438 A 2/1989 DeJonge
4,913,083 A * 4/1990 Valvo et al. ..... 116/308
5,009,338 A * 4/1991 Barker ..... 215/230
5,297,687 A * 3/1994 Freed ..... 215/206
5,356,012 A 10/1994 Tang et al.
5,732,836 A 3/1998 Barker et al.
5,803,283 A * 9/1998 Barker et al. ..... 215/230
5,984,122 A * 11/1999 Barker et al. ..... 215/230
6,068,149 A * 5/2000 Telega ..... 215/230
6,089,180 A * 7/2000 Nichols, Jr. ..... 116/309
7,222,736 B1 * 5/2007 Seijas ..... 206/534

OTHER PUBLICATIONS

International Search Report.

* cited by examiner

*Primary Examiner*—Mickey Yu
*Assistant Examiner*—Steven A. Reynolds
(74) *Attorney, Agent, or Firm*—F. Chau & Associates, LLC; Nathaniel T. Wallace, Esq.

(57) ABSTRACT

A bottle system includes a bottle having first tabs disposed on exterior sidewalls thereof and a cap assembly. The cap assembly includes a securing member including second tabs for cooperating with the first tabs to selectively secure the cap assembly to the bottle and an indicator member disposed between the securing member and the bottle having a sidewall visible through the securing member.

13 Claims, 5 Drawing Sheets

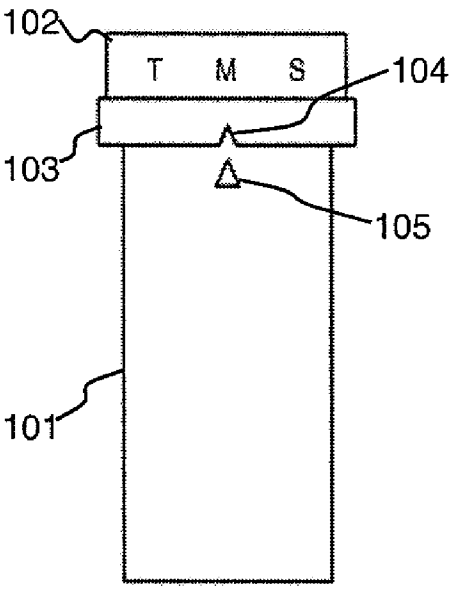
FIG. 6A
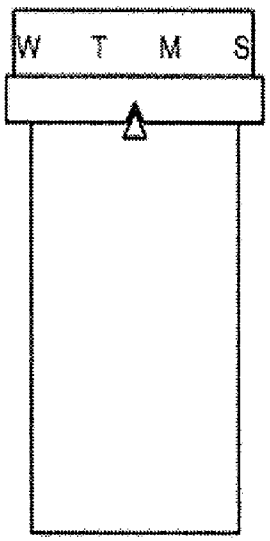
FIG. 6B
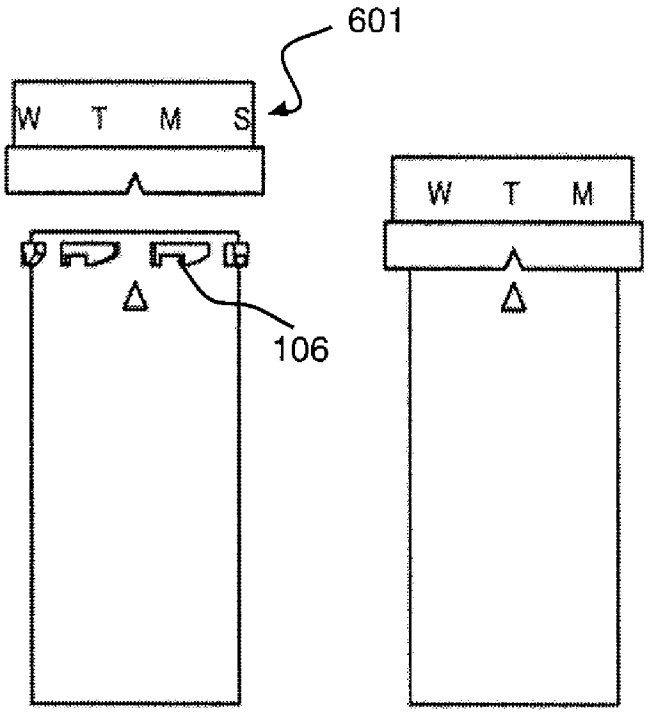
FIG. 6C
FIG. 6D

BOTTLE COMPRISING A TEMPORAL INDICATOR

CROSS-REFERENCE TO RELATED APPLICATION

This is a Continuation-In-Part of U.S. patent application Ser. No. 11/478,458, filed on Jun. 28, 2006, now U.S. Pat. No. 7,665,611 which is herein incorporated by reference in its entirety.

BACKGROUND OF THE INVENTION

1. Field of the Invention

The present invention relates to a container, and more particularly to a bottle indicating a date or time period.

2. Discussion of Related Art

Containers for planning or tracking a persons' use of medication or vitamins include elongated containers having separate compartments for each day of the week. These containers can be cumbersome to fill and require that different pills be allocated to different compartments correctly. These steps are a factor in non-compliance with doctor's orders or manufacturer's suggested daily requirements.

Therefore, a need exists for a bottle indicating a date or time period.

SUMMARY OF THE INVENTION

According to an embodiment of the present disclosure, a bottle system includes a bottle comprising first tabs disposed on exterior sidewalls thereof and a cap assembly. The cap assembly includes a securing member including second tabs for cooperating with the first tabs to selectively secure the cap assembly to the bottle, and an indicator member disposed between the securing member and the bottle having a sidewall visible through the securing member.

BRIEF DESCRIPTION OF THE FIGURES

Preferred embodiments of the present invention will be described below in more detail, with reference to the accompanying drawings:

FIGS. 6A-D illustrate opening and closing a bottle according to an embodiment of the present disclosure;

DETAILED DESCRIPTION OF PREFERRED EMBODIMENTS

Figure 1A:
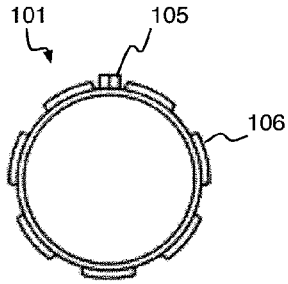
FIGS. 1A-C are top views of a bottle, cap, and ring, respectively, according to an embodiment of the present disclosure.
Figure 1B:
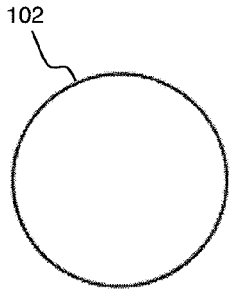
Figure 1C:
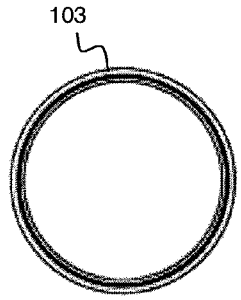

Referring to FIGS. 1A-C, 2A-C and 3, according to an embodiment of the present disclosure, a bottle 101 cooperates with a lid 102 and ring 103. The lid 102 includes a listing of times and/or days for administering medication, vitamins, and the like. The ring 103 includes a notch 104, which cooperates with an indicator 105 disposed on the bottle 101.

Figure 2A:
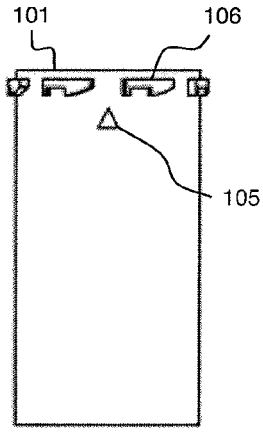
FIGS. 2A-D are side views of a bottle, cap, and ring, respectively, according to an embodiment of the present disclosure.
Figure 2B:
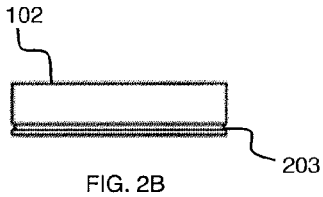
Figure 2C:
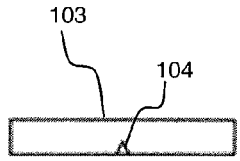
Figure 2D:
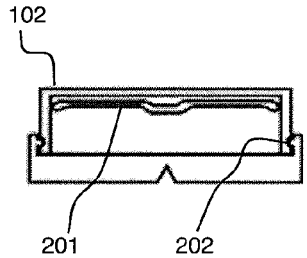
Figure 3:
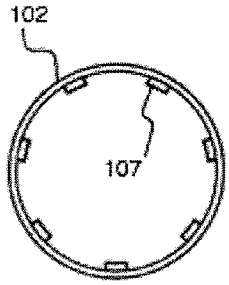
FIG. 3 is a bottom view of a cap according to an embodiment of the present disclosure.
Figure 4B:
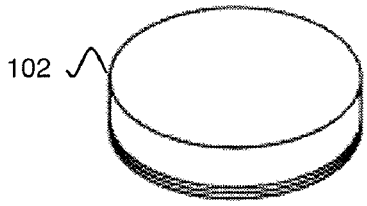
FIGS. 4A-C are perspective views of a bottle, cap, and ring, respectively, according to an embodiment of the present disclosure.
Figure 4C:
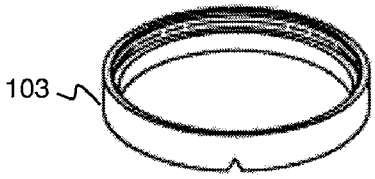
Figure 5:
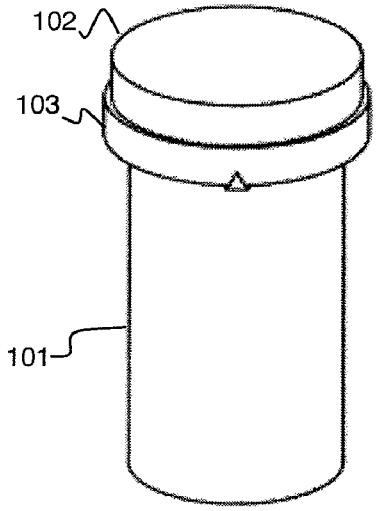
FIG. 5 is a perspective view of an assembled bottle, cap, and ring, respectively, according to an embodiment of the present disclosure.
Figure 4A:
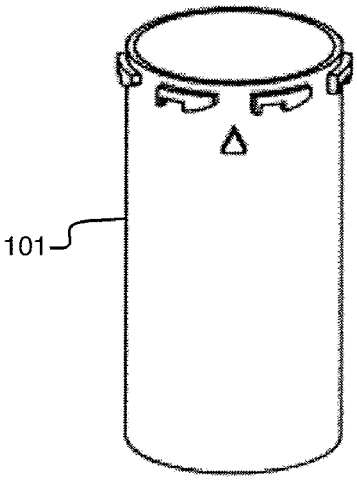

Referring to FIGS. 1A, 2A, and 3, the bottle 101 and the cap 102 comprise a locking mechanism for securing the cap to the bottle. The locking mechanism comprises cooperating tabs 106/107. Referring to FIG. 2D, the lock mechanism further comprises a diaphragm 201 disposed inside the cap for applying a force against an upper part of the bottle in a closed position. The diaphragm 201 pushes the bottle 101 away from the cap 102 and thus engages the cooperating tabs 106/107 when the cap 102 is appropriately arranged.

The number of tabs 106/107 and the position of the tabs 106/107 are arranged such that the listing, e.g., a day-of-the-week indication, is aligned with the indicator 105 when the cap is in a locked position (see for example, FIGS. 6A-1D).

Referring to FIG. 3, an exemplary embodiment of the locking mechanism includes substantially square tabs 107 disposed on one of the bottle or the cap. The locking mechanism further includes a shaped tab 106 (see FIG. 2A), adapted to receive and secure the square tabs 107. An opposing force is maintained between the cap 102 and bottle 101, for example, by a diaphragm disposed in the cap, wherein the bottle deflects the diaphragm such that the diaphragm generates the opposing force. One of ordinary skill in the art would appreciate that other locking mechanisms may be used.

Optionally, a ring 103 is disposed under the cap 102. The ring 103 rotates on to the cap 102 and engages into the indicator 105 when aligned with the notch 104 and depressed. Referring to FIG. 2D, the ring 103 includes a rib 202 cooperating with a grove 203 (see FIG. 2B) in the cap 102 to secure the ring 103 to the cap 102. The ring 103 is disposed having a friction fit, wherein rotation of the ring 103 is substantially prevented from freely rotating. When the cap 102 is rotated, the notch 104 and the indicator 105 stay engaged. This substantially prevents a user from putting the cap 102 back in the wrong position.

FIGS. 6A-D show a sequence of opening a bottle 101. Note that if the ring 103 is turned out of alignment with the indictor 105 on the bottle 101, the indicator 105 cannot engage in the notch 104, and the cap 102 cannot be depressed to disengage the tabs 106/107 and open the bottle 101. Accordingly, the ring 103 may be implemented as a further locking mechanism, substantially preventing opening of the bottle 101, by disposing the notch 104 in a misaligned position with respect to the indicator 105.

In the exemplary embodiment shown in FIGS. 1A and 3, seven tabs 106/107 are disposed on each of the bottle 101 and cap 102. This is an example of a bottle used where a dose is needed once per day.

The indicator 105 and listing (e.g., see FIG. 6C, 601) may be disposed on the cap 102 or on the bottle 101. Where the listing 601 is disposed on the bottle, the listing 601 may rotated on the bottle 101 each time a cap 102 is depressed and turned in a direction to open the bottle 101. The listing 601 rotates one increment each time the bottle 101 is opened.

Figure 7:
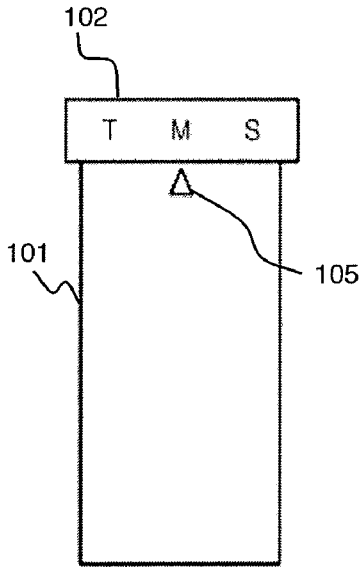
FIG. 7 is a diagram of a cap and bottle according to an embodiment of the present disclosure.

Referring to FIG. 7, according to an embodiment of the present disclosure, a system may include a bottle 101, a cap 102, and an indicator 105, without implementing a ring. The indicator 105 may be disposed on the bottle 101 or cap 102, and be disposed opposed a listing, for example, of dates and/or times. Further the indicator 105 may be provided in relief or as a graphic.

Referring to FIGS. 8A-D, the bottle 101 is implemented in conjunction with a cap assembly 801. The cap assembly 801 includes a securing member 802, an indicator member 803, and a ring member 804. The securing member 802 includes tabs 107 as illustrated in FIG. 3 for the cap 102. The indicator member 803 may function as a diaphragm 201 to force the securing member 802 away from the bottle 101, and to securely attach the cap assembly 801 to the bottle 101 via the tabs 106. Alternately, a pad, e.g., made of foam, may be disposed between the securing member 802 and the indicator member 803 to force the securing member 802 away from the bottle 101.

The ring member 804 includes a grove 809 that cooperates with a rim 810 of the securing member 802 to rotatably couple the ring member 804 and the securing member 802. The ring member 804 may include further information, for example, color coding for different p a temporal indication, e.g., hours. A user may rotate the ring member 804 to align a certain temporal indication, e.g., 3PM, with a given portion of the securing member 802 to indicate the last time a dose was taken/administered. For example, the ring may include 24 notches, e.g., 811, on an inside surface that cooperate with a bump 812 on a rim of the securing member 802, to be selecting rotatable to a particular alignment, e.g., 3PM as indicated on the ring member 804.

Figure 8A:
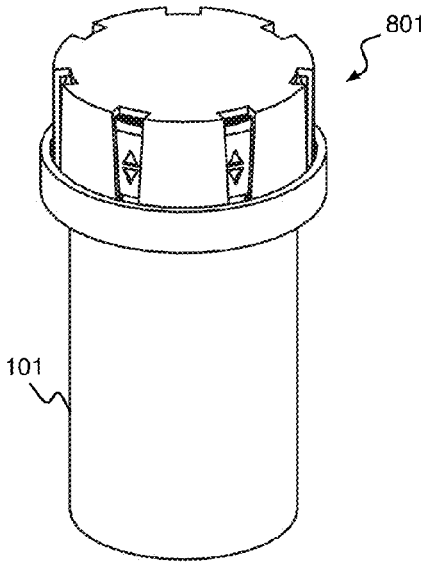
FIGS. 8A-D are diagrams of a bottle assembly according to an embodiment of the present disclosure.
Figure 8B:
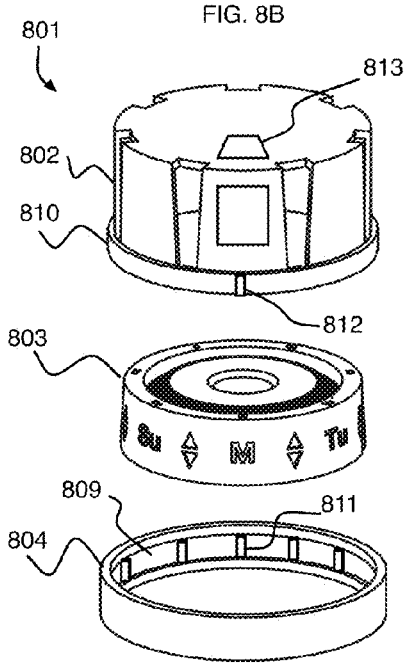
Figure 8C:
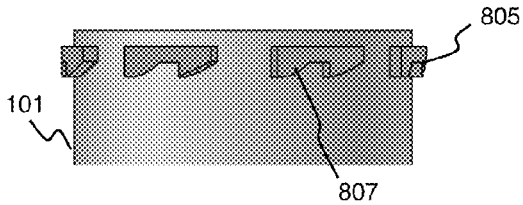
Figure 8D:
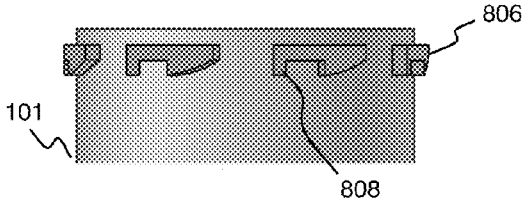
Figure 8D:
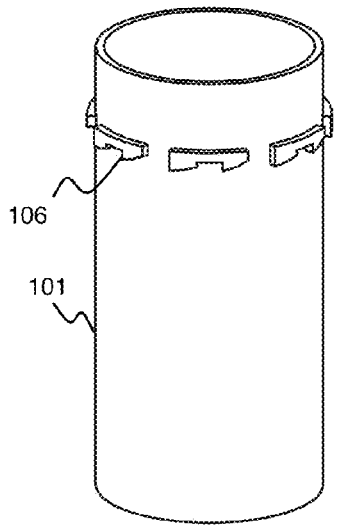

Referring to FIGS. 8C and 8D, the tabs may have various shapes. FIGS. 8C and 8D show two exemplary embodiments 805-806. The tab 805 includes a sloped release portion 807. The tab 806 includes a substantially vertical release portion 808. The release portions 807-808 function to impede rotation of the securing member 802.

Figure 9A:
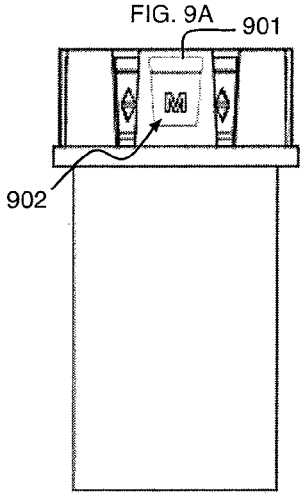
FIGS. 9A-G. illustrate opening and closing a bottle according to an embodiment of the present disclosure.
Figure 9B:
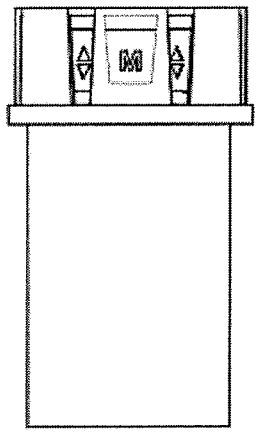
Figure 9C:
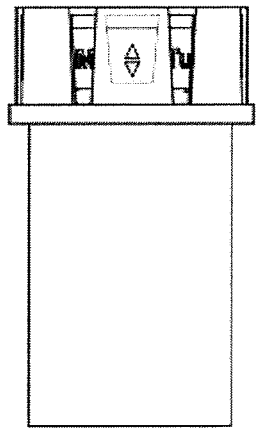
Figure 9C:
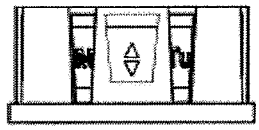
Figure 9D:
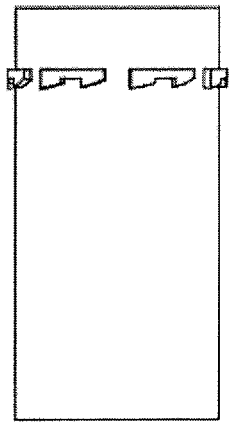
Figure 9E:
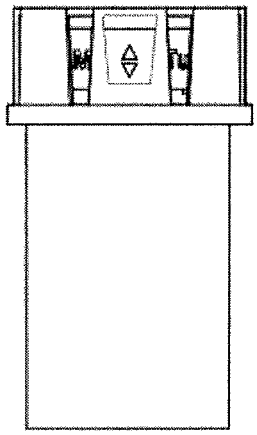
Figure 9F:
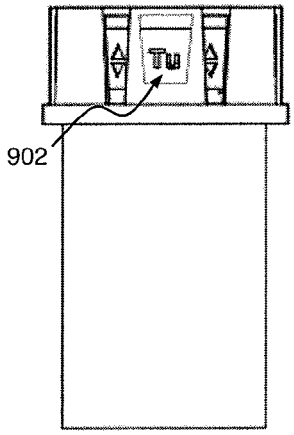
Figure 9G:
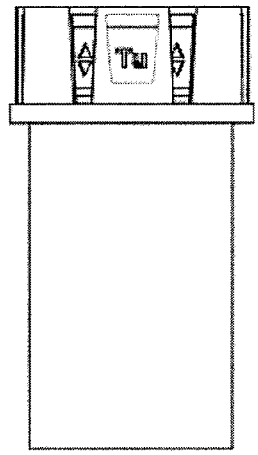

FIGS. 9A-G. illustrate opening and closing a bottle. The securing member 802 includes an opening 901 for revealing a portion of the indicator member 803, and more particularly, to reveal a temporal indication 902. The securing member 802 may be formed of a semi-transparent or opaque material, wherein the opening 901 is formed as a transparent portion. Similarly, the securing member 802 and opening 901 may both be transparent but may have different tints, shades, frosting, etc., to distinguish the opening 901. A portion of the indicator member 803 may also be visible through a top surface of the securing member 802—that is a second opening 813 may be formed on the top surface. FIG. 9A illustrates a bottle and cap assembly showing an "M" indication. FIG. 9B illustrates that the cap assembly is depressed such that tabs of the securing member may clear tabs of the bottle. FIG. 9C illustrates a rotated state of the securing member, wherein the indicator member does not rotate, and is maintained at a rotation relative to the bottle via friction there-between. FIG. 9D illustrates release of the cap assembly from the bottle; that is release of the tabs of the cap assembly from the tabs of the bottle. FIG. 9E illustrates the placing of the cap assembly on the bottle, wherein the tabs of the cap assembly and the bottle are mis-aligned and the cap assembly is depressed on the bottle such that tabs of the securing member may clear tabs of the bottle. FIG. 9F illustrates a rotated state of the securing member, wherein the indicator member does not rotate, and is maintained at a rotation relative to the bottle via friction there-between. Note that the revealed temporal indication 902 has been incremented via the unidirectional rotation of the securing member relative to the indicator member. FIG. 9G illustrates a bottle and cap assembly showing an "Tu" indication.

Having described embodiments for a bottle indicating a date or time period, it is noted that modifications and variations can be made by persons skilled in the art in light of the above teachings. It is therefore to be understood that changes may be made in the particular embodiments of the invention disclosed which are within the scope and spirit of the invention as defined by the disclosure.

What is claimed is:

1. A bottle system comprising:

a bottle comprising first tabs disposed on exterior sidewalls thereof; and a cap assembly, the cap assembly comprising:

a securing member including second tabs for cooperating with the first tabs to selectively secure the cap assembly to the bottle; and an indicator member disposed between the securing member and the bottle having a sidewall visible through the securing member, the sidewall bearing a temporal indicia, wherein the cap assembly is characterized by an increment process including a removal of the cap assembly from the bottle and a subsequent coupling of the cap assembly to the bottle, wherein the removal and subsequent coupling are performed by rotating the cap in the same direction relative to the bottle, to perform one increment of the temporal indicia visible through the securing member.

2. The bottle system of claim 1, wherein the indicator member is a diaphragm for forcing the securing member away from the bottle and to engage the first and second tabs.

3. The bottle system of claim 1, further comprising a pad disposed between the securing member and the indicator member for forcing the securing member away from the bottle and to engage the first and second tabs.

4. The bottle system of claim 1, wherein the securing member includes an opening in a sidewall thereof for revealing a portion of the sidewall of the indicator member.

5. The bottle system of claim 4, wherein the opening is transparent and the securing member is opaque or semi-transparent.

6. The bottle system of claim 1, wherein the securing member includes an opening in a top surface thereof for revealing a portion of a top surface of the indicator member.

7. The bottle system of claim 6, wherein the opening is transparent and the securing member is opaque or semi-transparent.

8. The bottle system of claim 1, further comprising a ring member rotatably coupled to the securing member.

9. The bottle system of claim 1, wherein the securing member is rotatable relative to the indicator member and bottle.

10. The bottle system of claim 1, wherein a rotation of the indicator member relative to the bottle is maintained via friction between the indicator member and the bottle.

11. The bottle system of claim 1, wherein each first tab includes two sloped portions arranged in a same direction and one sloped portion further includes a vertical release portion, the vertical release portion having a height less than a height of the one sloped portion.

12. The bottle system of claim 1, wherein each first tab includes a sloped portion and a vertical release portion.

13. The bottle system of claim 8, wherein the ring includes a plurality of notches on an inside surface that cooperate with a bump of the securing member, wherein the ring is selectably rotatable according to locations of the notches.

* * * * *